United States Patent [19]

Farhat et al.

[11] 3,985,231

[45] Oct. 12, 1976

[54] APPARATUS FOR TRANSPORTING STORING AND DISPENSING FRANGIBLE MATERIAL

[75] Inventors: David L. Farhat, Dearborn Heights; Richard S. Reihm, Pleasant Ridge, both of Mich.

[73] Assignee: Container Systems Corporation, Dearborn Heights, Mich.

[22] Filed: Mar. 31, 1975

[21] Appl. No.: 563,593

[52] U.S. Cl. ..... 206/448; 206/521; 206/451

[51] Int. Cl.[2] ..... B65D 85/48; B65D 81/02; B65D 85/30

[58] Field of Search ..... 206/448–456, 206/521

[56] References Cited

UNITED STATES PATENTS

| | | | |
|---|---|---|---|
| 2,953,253 | 9/1960 | Henderson et al. | 206/448 |
| 3,147,860 | 9/1964 | Kean, Sr. et al. | 206/448 |
| 3,216,564 | 11/1965 | Wolfe, Jr. et al. | 206/448 |
| 3,809,234 | 5/1974 | Kurick | 206/448 |
| 3,887,071 | 6/1975 | Thomaswick | 206/454 |

*Primary Examiner*—William Price
*Assistant Examiner*—Douglas B. Farrow
*Attorney, Agent, or Firm*—Harness, Dickey & Pierce

[57] ABSTRACT

An apparatus for transporting and storing frangible material, such as glass plates and the like and including a storage console including two generally vertically disposed frames spaced longitudinally away from one another, each of the frames defining a pair of vertically spaced channel-like guideways, with each of the guideways being provided with a compressible deformable element defining a series of plate edge receiving recesses, a pair of elongated upright stanchion members movable to and from a position causing the compressible elements to compressingly engage the edges of a series of plates received within the recesses, whereby to support, constrain and suspend the plates in a unified mass, and a pallet-like base and optional shroud for enclosing the constrained plates and providing for convenient transport and storage thereof.

41 Claims, 14 Drawing Figures

APPARATUS FOR TRANSPORTING STORING AND DISPENSING FRANGIBLE MATERIAL

SUMMARY OF THE INVENTION

Generally speaking, the present invention relates to the packaging of frangible materials of a sheet-like nature, such as glass plates or the like. More particularly, the present invention is directed toward a novel packing system particularly, although not necessarily, adapted for use in the shipment, storage, dispensing and related handling of vehicular windows, and which is adapted to function in supporting, suspending and constraining a multiplicity of such windows in a manner such that a collective package thereof is in the form of a relatively rigid unified mass within the inner walls of an associated protective shipping or storage container. The present invention is particularly suitable for the bulk shipping and storage of frangible plates in quantities, for example, in the general range of from eight to 25 plates per container.

As is well known, glass, although being inherently strong, is easily fractured when subjected to a pressure loading at a rate which is greater than the structure can accommodate or dissipate. Consequently, in the shipping, storage and handling of frangible glass plates, the plates must be held firmly in their associated containers, yet they must be supported in a manner that allows for any shock forces, to which the plates are subjected during normal handling, to be absorbed, dissipated or otherwise minimized to the extreme. This is particularly true with regard to vehicular windshields, side and rear lites, which are frequently of a relatively arcuate configuration and are subjected to considerable handling during transportion through long distribution channels from the manufacturer to the ultimate location wherein the glass is installed in a vehicle. While there are presently a number of methods employed in the bulk shipping of frangible plates, such as vehicular windshields and the like, particularly in the windshield replacement market, such methods generally utilize some variation of the basic concept of securing two or more rigid slotted logs or blocks, usually composed of corrugated fiber-board or the like, to the interior floor or base of a pallet or associated shipping container and into which slots are fitted the aforementioned plates. One such method, which additionally employs a plurality of small folded fiberboard pads provided with an adhesive material interiorly thereof that aids in constraining the packaged plates, is described in U.S. Pat. No. 3,414,124, issued to E. A. Lidgard, on Dec. 3, 1968.

While such above described methods have found considerable commercial success, they have been objectionable for a number of reasons, not the least of which is the high cost of the logs or blocks themselves, as well as the fact that they create certain alignment problems and usually require supplemental complex dunnage elements. Moreover, the pads or logs utilized in the aforementioned system shown in U.S. Pat. No. 3,414,124, have been found to be objectionable in that the retaining adhesive material frequently remains adhered to the glass plates and must be subsequently removed at additional cost. Furthermore, under some conditions, the material from which the pad elements are fabricated may result in abrasion to the glass plates. The objection is directed toward the requirement for supplement dunnage elements are many; the main one being the multiplicity of such elements itself; the complexity of design and cost due to such complexity, and the resultant labor or manufacturing cost. More importantly, however, these prior art methods result in an objectionably high degree of breakage, particularly under certain adverse climatic conditions; for example, since the support logs or blocks are typically fabricated of corrugated paperboard, under high humidity conditions, the blocks frequently deteriorate prematurely, thus rendering the associated frangible plates inadequately supported.

The present invention is directed toward a new and improved bulk packing system of the aforementioned character which overcomes the objectionable characteristics of prior known methods, particularly the type shown in the aforesaid patent. More particularly, the present invention is directed toward a new and improved packing apparatus for frangible plates, such as vehicular windshields, side and rear lites and the like, which obviates the need for the afore-mentioned blocks or pad elements, and at the same time, provides a packing arrangement that functions in a highly economical manner in positively supporting and suspending frangible plates so as to effectively minimize damage thereof during shipment, storage and related handling. Furthermore, the apparatus of the present invention serves the dual purpose of enabling convenient dispensing of frangible plates therefrom, whereby plate glass can be dispensed either from an upright position, as is now customary in the industry, or from a horizontal position which cannot effectively be performed by any existing packaging arrangement. As will be appreciated by those skilled in the art, the horizontal dispensability allows far greater inventory density, thus greatly enhancing the economies of storage. Additionally, such horizontal plate dispensing obviates the frequent need of cumbersome ladders and the like by allowing a warehouseman to easily remove the plates from a horizontal position while remaining on ground level.

It is accordingly a general object of the present invention to provide a new and improved packing system of the above described character which is adapted to function in positively restraining, supporting and suspending frangible sheet-like materials, particularly materials such as glass used as vehicular windshields, side and rear lites, by retaining the same in a solid unified mass.

It is a more particular object of the present invention to provide a new and improved packing system wherein the glass sheets are subjected to a compressive force so that the same are retained in a solid unified mass, and wherein the resultant strength of the mass is utilized to supplement the structural integrity of the container construction.

It is another object of the present invention to provide a new and improved packing system which may be conveniently pre-assembled and thereby be maintained in inventory preparatory to the packing, storage, or other handling of frangible sheet-like materials.

It is a further object of the present invention to provide a new and improved packing system, as above described, which may be quickly and easily packed directly off a production line, and which thereby reduces the need, now present in the industry, of multistage packing and handling stations.

It is yet another object of the present invention to provide a new and improved packing system that can be utilized in a manner so as to permit direct dispensing therefrom in either an upright (vertical) or horizontal position.

It is still a further object of the present invention to provide a new and improved packing system which provides for maximum visibility of the frangible plates contained therein, whereby to minimize to the extreme the possibility of undetected plate damage.

It is another object of the present invention to provide a packing system, of the above described type, which is not affected by temperature, humidity, or related ambient temperature conditions and which can be stacked upright, horizontally and on end so as to provide for universality of inventory storage, transport and the like.

It is another object of the present invention to provide a new and improved packing system which may be utilized for a multiplicity of different size glass plates so as to minimize the inventory of container sizes.

It is still a further object of the present invention to provide a packing system which is constructed so as to accommodate fork lift trucks in a manner such that a truck may approach and engage the container at either side or at either end, and which is further designed so as to minimize the need for any ancillary dunnage.

Other objects and advantages of the present invention will become apparent from the following detailed description taken in conjunction with the accompanying drawings.

BRIEF DESCRIPTION OF THE DRAWINGS

FIG. 2 is an elevated perspective view, partially broken away, of the packing apparatus of the present invention in a completely assembled form and contains a plurality of frangible plates in the form of a vehicle windshield or the like;

DESCRIPTION OF A PREFERRED EMBODIMENT

As used herein, the terms "vertical", "horizontal", "up", "down", "inner", "outer", and various derivatives thereof are used merely for purposes of clarity in description and are in no way intended to limit the present invention as defined by the claims appended hereto.

Figure 1:
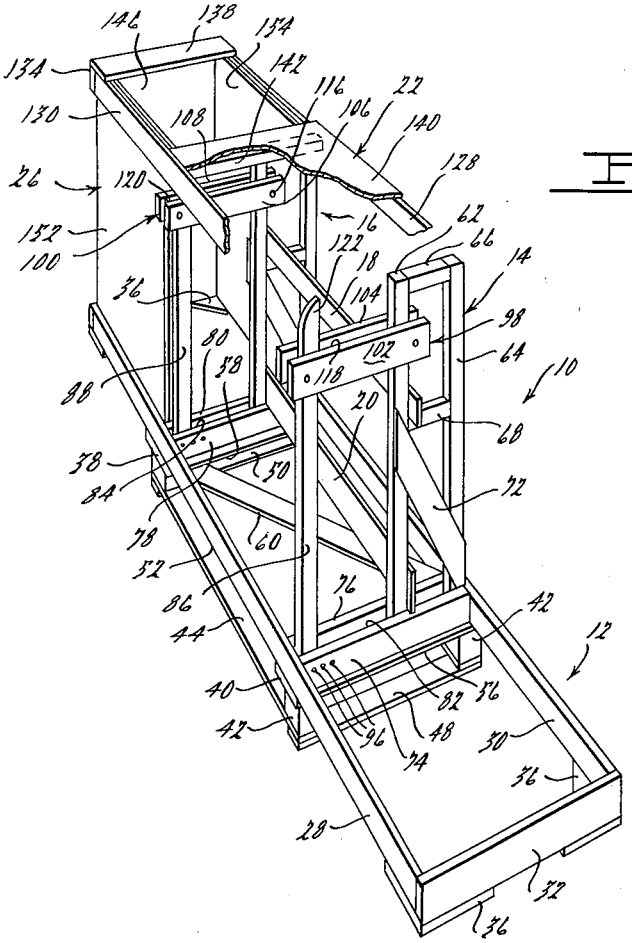
FIG. 1 is an elevated perspective view, partially broken away, of the plate packing, transport and storage apparatus of the present invention.
Figure 2:
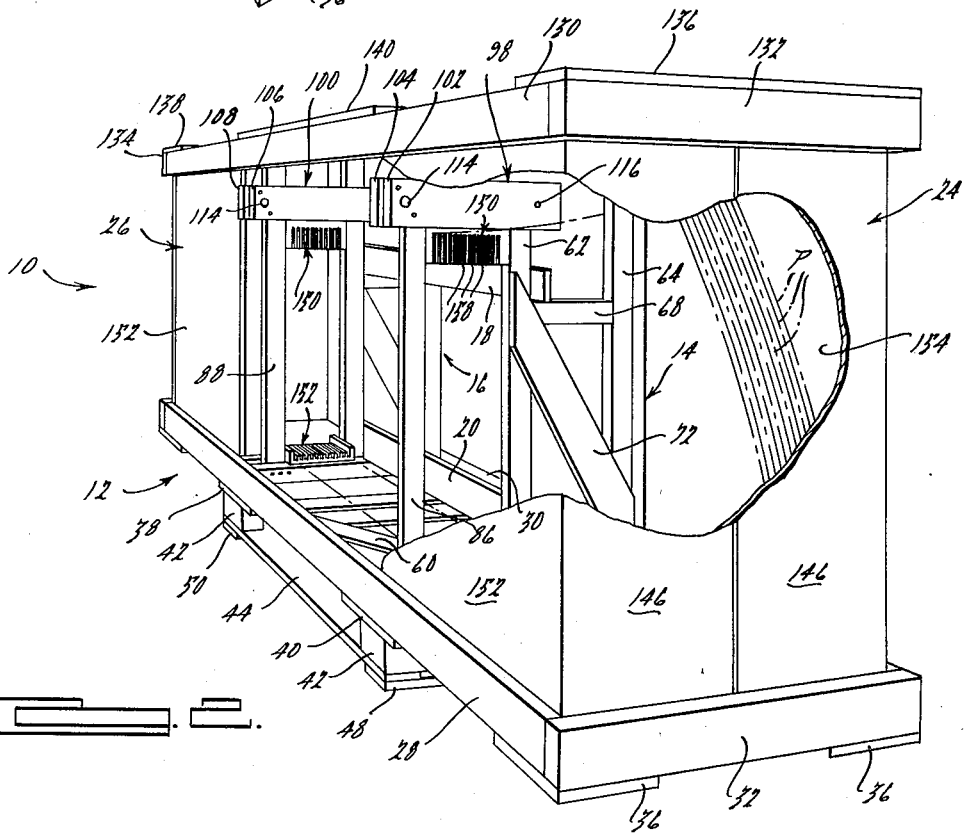

Referring now in detail to the drawings and in particular to FIGS. 1 and 2 thereof, an apparatus for packing, transporting, storing and dispensing frangible plates, in accordance with one preferred embodiment of the present invention, is generally designated by the numeral 10 and is shown as comprising a lower support structure or pallet base 12. Disposed above and supported upon the base 12 is a pair of longitudinally spaced, generally vertically extending frame assemblies 14 and 16 which are interconnected by means of a pair of vertically spaced, longitudinally extending upper and lower longitudinal cross members 18 and 20. Enclosing the upper end of the apparatus 10 is an elongated cover, generally designated by the numeral 22, which cooperates with a pair of generally U-shaped end shrouds 24, 26 located at the opposite ends of the apparatus 10 and extending between the pallet base 12 and the cover 22. The apparatus 10 is adapted to protect a plurality of frangible plates, herein generally referred to by the letter P, which may, for example, comprise a plurality of vehicle windshields or similar frangible articles that are to be packed, stored, transported and/or dispensed from the apparatus 10 of the present invention, as will hereinafter be described in detail.

As best seen in FIG. 1, the pallet base 12 comprises a pair of laterally spaced parallel longitudinally extending side rails 28 and 30 which are interconnected at their opposite ends by means of a pair of longitudinally spaced, laterally extending end rails 32 and 34. Disposed at the intersections of the side rails 28, 30 and the end rails 32, 34 is a plurality of four generally triangular-shaped reinforcing members, generally designated by the numeral 36 which are secured to the underside of the rails 28–34 by any suitable fastening means, such as nails, screws, adhesive or the like. As will be appreciated by those skilled in the art, the reinforcing members 36 serve to rigidify the pallet base 12 and further serve as a bottom "stop" or support for the end shrouds 24, 26 which are nestingly received within the opposite ends of the pallet base 12 in a manner hereinafter to be described.

Extending laterally between the side rails 28, 30 at positions generally underlying the frame assemblies 14, 16 is a pair of floor plates 38 and 40 which serve to provide lateral support for the pallet base 12 and dissipate or distribute the weight of the frangible plates P which are to be packed within the apparatus 10. Depending downwardly from each end of each of the floor plates 38, 40 is a foot member 42 which serves as a support column for the pallet base 12 of apparatus 10. Extending longitudinally between the longitudinally aligned members 42 is a pair of longitudinal stringers 44 and 46 which are arranged generally below the longitudinal side rails 28, 30, respectively. A pair of laterally extending stringers 48, 50 extend between the pair of members 42 associated with each of the floor plates 38, 40. The stringers 44, 46 and 48, 50 define longitudinal access openings 52 and 54 on the front and rearward sides of the apparatus 10 and lateral access openings 56 and 58 at the laterally opposite ends of the pallet base 12 of the apparatus 10. These access openings 52–58 are adapted to receive the tines of a fork lift truck or similar type device for tansporting the entire apparatus 10 and the frangible plates P contained therewithin, as will be appreciated by those skilled in the art. In order to further rigidify the base 12, a diagonal cross brace 60 extends between the rearward end of the floor plate 38 and the forward end of the floor plate 40 at a position generally interjacent the frame assemblies 14, 16, as best seen in FIGS. 1 and 2.

Figure 6:
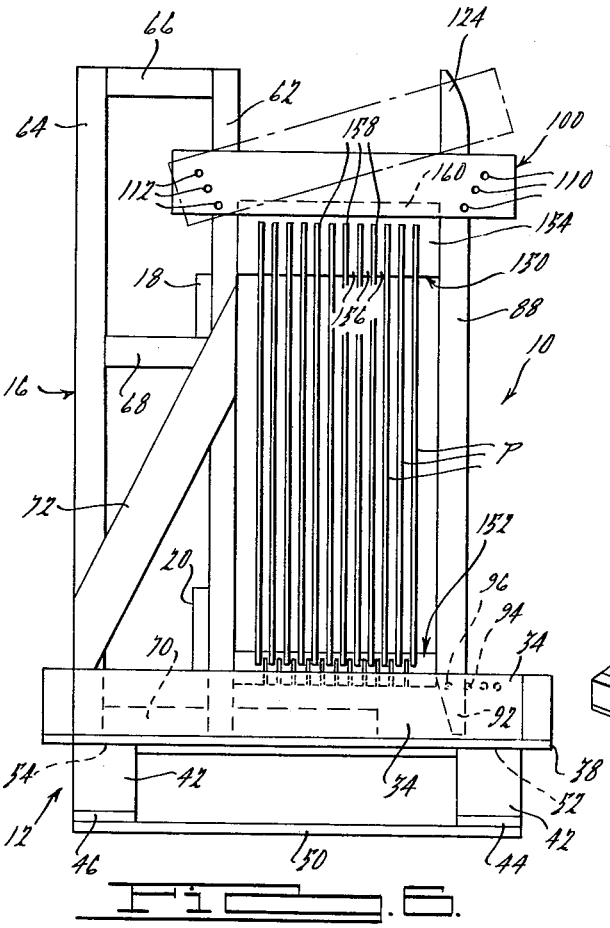
FIG. 6 is an end elevational view of the packing apparatus of the present invention and shows the various components thereof in operative association with a plurality of frangible plates in a fully compressed and packaged condition.

Referring now in detail to the construction of the frame assemblies 14, 16, by virtue of the fact that each of these assemlies is of an identical construction, the following description of the various component parts thereof will be applicable to each of the assemblies 14, 16 even though such description is directed toward only a single frame assembly. As best seen in FIG. 6, the frame assembly (either 14 or 16) includes a pair of generally vertically extending, laterally spaced front and rear upright members 62 and 64, respectively, between which extend a plurality of cross beams; namely, an upper cross beam 66, an intermediate cross beam 68 and a lower cross beam 70. Additionally, a diagonal cross brace 72 extends upwardly from the lower end of the rear upright member 64 to a position adjacent the center or intermediate portion of the front upright member 62. As shown in FIG. 1, the longitudinal cross members 18 and 20 are fixedly secured at their opposite ends to the rearward sides of the forward or front upright members 62 of the frame assemblies 14, 16 in order to rigidify the same against any relative movement therebetween.

Disposed directly above the floor plates 38 and 40 interjacent the longitudinal side rails 28, 30 of the pallet base 12 is two pair of spaced parallel restraining members 74, 76 and 78, 80, respectively. The restraining members 74, 76 define a laterally extending channel 82 therebetween, and in a similar manner, the restraining members 78, 80 define a longitudinally extending channel 84 therebetween. The lower ends of the vertical frame assemblies 14, 16 are nestingly received within the rearwardmost portions of the channels 82, 84 in the manner best shown in FIG. 6. Disposed directly forwardly of the frame assemblies 14, 16 within the channels 82, 84 is a pair of generally vertically extending compression stanchions 86, 88. The stanchions 86, 88 include tapered lower end sections 90, 92, respectively, which are nestingly received within the forward ends of the channels 82, 84. As illustrated in FIG. 6, a pair of pivot pins, generally designated by the numeral 94, extend longitudinally through aligned pairs of apertures 96 formed within the forward ends of the restraining members 74, 76 and 78, 80 directly rearwardly of the front longitudinal side rail 28. The pivot pins 94 may be of any suitable construction, but are illustrated herein as comprising bolts of suitable length having threaded end portions upon which wing nuts or the like may be provided in order to permit convenient removal and adjustment thereof. It will be noted that the apertures 96 formed within the restraining members 74, 76 and 78, 80 are arranged in longitudinally aligned, laterally spaced pairs, whereby to provide for lateral adjustment of the location of the pivot pins 94.

The upper ends of the stanchions 86, 88 are adapted to be operatively maintained in a generally upright position wherein the stanchions 86, 88 extend generally vertically or parallel to the front and rear upright members 62 and 64 of the frame assemblies 14, 16. Means for thus operatively positioning the compression stanchions 86, 88 is provided by a pair of restraining yokes 98 and 100 which are operatively associated with the vertical frame assemblies 14 and 16, respectively, and the stanchions 86, 88, respectively. The restraining yoke 98 comprises a pair of spaced apart, restraining members 102, 104, and in a like manner, the yoke 100 comprises a pair of spaced apart restraining members 106 and 108. The yokes 98 and 100 extend generally forwardly from the front upright members 62 of the frame assemblies 14, 16, with the members 102, 104 and 106, 108 being located on the opposite sides of the upright members 62 associated with each of the frame assemblies 14, 16, respectively. The restraining yokes 98, 100 are adapted to be pivotal about a generally horizonal axis in FIG. 6 between the solid line position shown on this figure and the phantom line position shown therein.

The forward ends of the restraining members 102, 104 and 106, 108 are formed with a plurality of pairs of longitudinally aligned forward apertures 110, and in a similar manner, the rearward ends of the restraining members 102–108 are formed with a plurality of pairs of longitudinally aligned rearward apertures 112. Means in the form of a pair of bolts 114 extend through selected pairs of aligned apertures 110 at the forward ends of the members 102–108, and similar bolts 116 extend through selected aligned apertures 112 of the pairs of members 102, 104 and 106, 108, as best shown in FIGS. 1 and 2. The bolts 114, 116 may be any suitable construction and are shown herein as being provided with suitable manually removable wing nuts or the like to provide for adjustment when it is desired to locate the bolts in certain of the apertures 110 and 112. It will be noted that the apertures 110, 112 are located at different vertical and horizontal spaced locations, whereby to provide for adjustability of the position of the bolts 114, 116 for purposes hereinafter to be described.

The restraining members 102, 104 of the restraining yoke 98 define a laterally extending channel 118 therebetween, which channel 118 is disposed in vertical alignment with the channel 82 defined by the restraining members 74, 76. In a similar manner, the restraining members 106, 108 of the yoke 100 define a laterally extending channel 120 which is in generally vertical alignment with the channel 84 defined by the restraining members 78, 80. As shown in FIG. 1, the forward upright members 62 of the frame assemblies 14, 16 extend upwardly through the rearward ends of the channels 118, 120, while the upper ends of the stanchions 86, 88, herein designated by the numerals 122 and 124, are adapted to extend upwardly through the forward ends of the channels 118, 120. The upper end sections 122, 124 of the stanchions 86, 88 are provided with longitudinally extending notches in the forward side thereof adapted for engagement with the bolts 116 extending through the restraining members 102, 104 and 106, 108, whereby to support the associated restraining yokes 98, 100 in a generally vertical orientation as shown in FIG. 6, for purposes hereinafter to be described. In accordance with the present invention, a plurality of frangible plates P are adapted to be placed in longitudinally aligned relationship on the restraining members 74, 76 and 78, 80 between the forward sides of the forward upright members 62 of the frame assemblies 14, 16 and the rearward sides of the compression stanchions 86, 88, after which time the restraining yokes 98, 100 are adapted to be moved to an operative position in generally surrounding relation with the upper ends 122, 124 of the stanchions 186, 188 to maintain the plurality of plates P in a predetermined restrained configuration within the apparatus 10 during storage, transport and the like thereof, as will hereinafter be described in detail.

Figure 10:
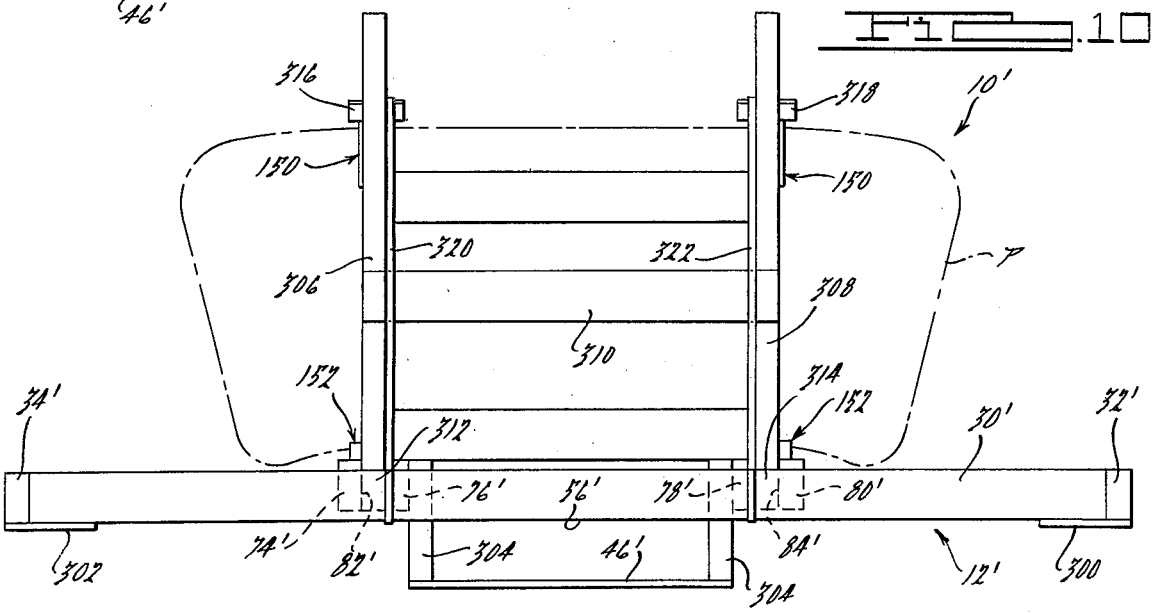
FIG. 10 is a back view of the apparatus of the present invention shown in FIG. 8.
Figure 11:
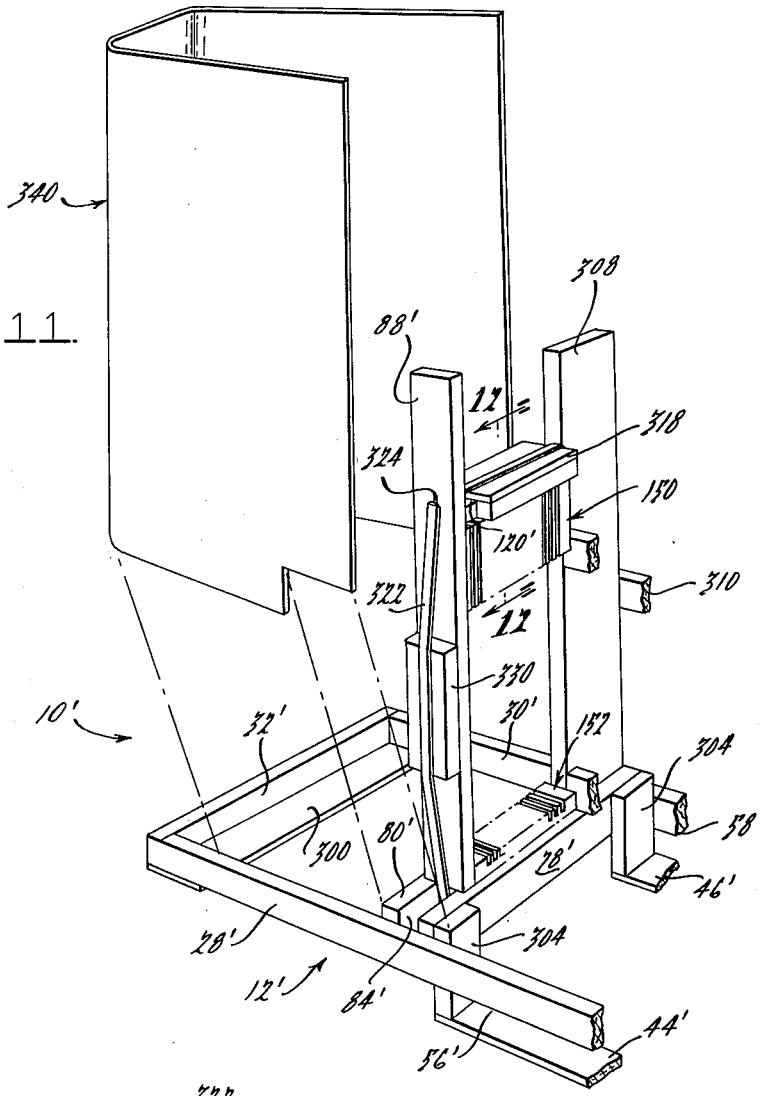
FIG. 11 is an exploded view of the apparatus shown in FIG. 8 as shown in operative association with typical enclosure and protective shrouds.

As best seen in FIG. 10, the cover 22 of the apparatus 10 includes a pair of longitudinally extending, laterally spaced side rails 128 and 130 which are connected at their opposite ends by means of a pair of laterally extending longitudinally spaced end rails 132, 134. A pair of top braces, herein designated by the numerals 136 and 138, extend laterally between the upper sides of the side rails 128, 130. Also extending between the side rails 128, 130 is a cover plate 140 which is located intermediate the opposite ends of the cover 22 and is in general vertical alignment with the center of the pallet base 12 upon assembly of the cover 22. A pair of lock rails 142 and 144 are secured to the underside of the cover plate 140 and extend between the inner confronting sides of the side rails 128, 130. The cover plate 140 is dimensioned such that it will fit interjacent the lateral stringers 48, 50 of the pallet base 12 of a similar apparatus 10 which is disposed thereabove, as shown in FIG. 11, whereby to provide for convenient and stable stacking of two or more of the apparatus 10 on top of each other. It will be seen that the lateral spacing between the side rails 128, 130 is such that when the cover 22 is mounted upon the upper ends of the vertical frame assemblies 14, 16, the inner surface of the side rail 130 confronts the rearward upright member 64 of the frame assemblies 14, 16, whereas the inner surface of the side rail 128 confronts the forward side of the upper ends of stanchions 86, 88. Furthermore, the size of the cover 22 preferably corresponds to the size of the pallet base 12, whereby the end rails 132, 134 are generally vertically aligned with the lateral end rails 32, 34 of the pallet base 12 and cooperate therewith to constrain the end shrouds 24, 26, in a manner hereinafter to be described.

Figure 12:
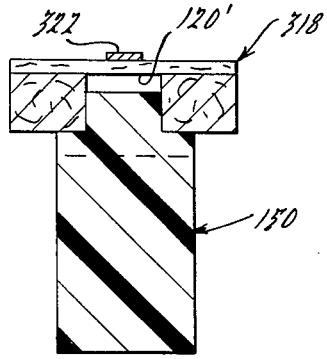
FIG. 12 is a transverse cross-sectional view taken substantially along the line 12—12 of FIG. 11.

The shrouds 24, 26 are generally identical in construction and are of a U-shaped configuration in plan view (see FIG. 12). The shrouds 24, 26 are preferably fabricated of a corrugated fiberboard or the like and are intended to enclose the opposite ends of the apparatus 10, whereby to protect the terminal ends of the plates P packed therewithin. As shown in FIG. 12, the shrouds 24, 26 comprise inner end sections 146 which extend vertically between and in a same general plane as the end rails 32, 34 and the end rails 132, 134. The opposite ends of the inner end section 146 are formed with a pair of parallel right angle folds 148 and 150 which partially define front and rearward inner side sections 152 and 154 that extend generally coplanar of the forward and rearward sides of the apparatus 10. As previously mentioned, the shrouds 24, 26 are adapted to be retained within the confines of the pallet base 12 and the cover 22, with the lower ends of the shrouds 24, 26 bearing upon the reinforcing members 36 located at the corners of the pallet base 12. Means in the form of suitable staples or the like may be utilized for retaining the shrouds 24, 26 and in the operative position shown in the drawings.

Figure 3:
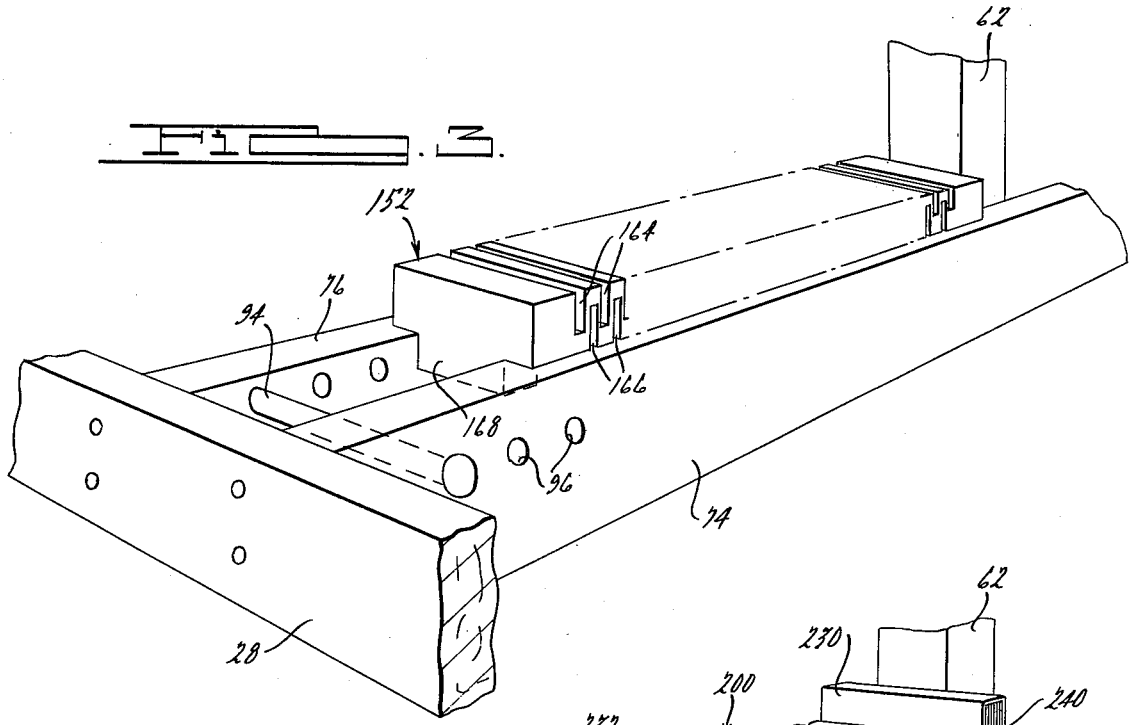
FIG. 3 is an elevated perspective view of one embodiment of the plate retaining element utilized in the packing, transport and storage apparatus of the present invention.
Figure 4:
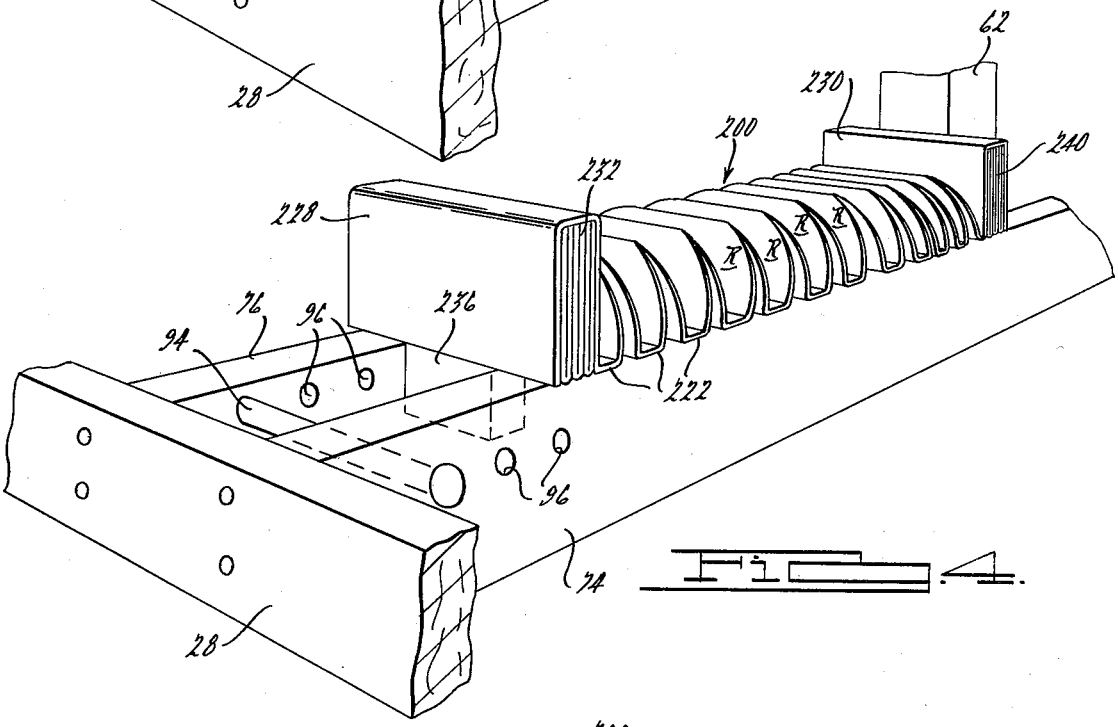
FIG. 4 is an elevated perspective view of another embodiment of the plate separator and retaining element incorporated in the packing, transport and storage apparatus of the present invention.
Figure 5:
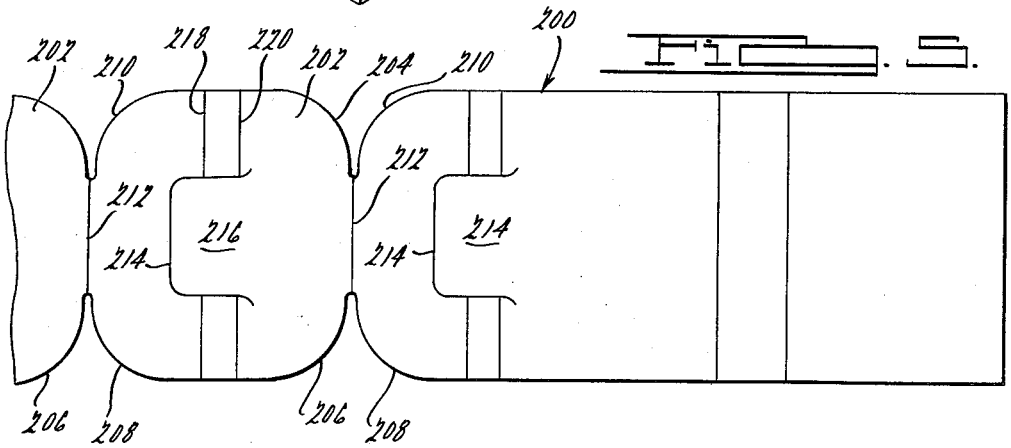
FIG. 5 is a fragmentary plan view of a die cut blank from which the retaining element shown in FIG. 4 is fabricated.

In accordance with the principles of the present invention, means is provided within each of the channels 82, 84 and 118, 120 of the pairs of restraining members 74, 76; 78, 80; 102, 104; and 106, 108, respectively, for compressingly engaging the frangible plates P in a manner such that positive retention is provided against any movement of the plates P within the apparatus 10 upon final a assembly thereof. Such means comprises a pair of upper plate separator and retaining elements, generally designated by the numeral 150 and a pair of lower plate separator and retaining elements 152. As illustrated in FIG. 2, the upper elements 150 comprise a body 154 fabricated of a relatively resilient deformable foam-like material such as polyurethane, polyethylene or a similar molded polymeric material. Depending downwardly from the lower side of the body 154 is a plurality of laterally spaced fingers, generally designated 156, that define a plurality of spaced parallel recesses 158 therebetween. Extending upwardly from the upper side of each of the elements 150 is an elongated upper projection portion 160 adapted to be nestingly received within the channels 118, 120 defined by the yokes 98, 100, whereby the recesses 158 are adapted to receive the upper edges of the plates P disposed within the apparatus 10. As best seen in FIG. 3, the lower elements 152 each comprise a generally accordian-shaped body 162 fabricated of a similar deformable foam-like material as the elements 150. The upper and lower sides of the elements 152 are formed with alternate upper and lower recesses 164 and 166, respectively, with the upper recesses 164 being adapted to receive the lower edges of the plates P disposed within the apparatus 10. The underside of each of the lower elements 152 is formed with a downwardly projecting portion 168 adapted to be nestingly received within the channels 82, 84. FIGS. 4 and 5 illustrate an alternate embodiment of the present invention wherein the elements 150, 152 are replaced by separator and retaining pads 200 that are each fabricated of a strip of a corrugated material, such as polyethylene, neoprene or other suitable temperature and moisture resistant material which will retain its structural rigidity yet is sufficiently deformable to absorb any impact shock loading to which the apparatus 10 may be subjected and hence prevent such shock loading from being transmitted to the plates P packed therewithin. In a preferred construction, the material from which the pads 200 are fabricated includes a multiplicity of air chambers which provide for the desired compression or deformation thereof during packing and at such time as the apparatus 10 is subjected to appreciable shock or impact loading. With reference now to FIG. 5, it will be seen that the pads 200 constitute a plurality or series of aligned plate separator and retaining sections 202. Each of the sections 202 is of a generally rectangular configuration with the corners thereof being arcuately formed, as seen at 204, 206, 208 and 210. The individual sections 202 are delineated or separated by creases or folds 212 which extend transversely of the length of the pads 200 between the rounded corners thereof. The center of each of the pad sections 202 is formed with a generally U-shaped lance or slit 214 which extends entirely therethrough and defines a tongue or tab section 216. In addition, each of the tab sections 202 is formed with a pair of spaced parallel creases 218, 220 which extend transversely of the strip of sections 202 and enables the pad to be formed into a generally accordion-shaped configuration hereinafter to be described in detail. When the pads 200 are thus folded, each of the pad sections 202 defines a base portion 222 delineated between the the creases 218 and 220, and a pair of projecting side portions 224, 226. The portions 222–226 of each of the pad sections 202 defines a recess, generally designated by the letter R, with the result that when the pads are folded along their entire length, a series of recesses R are provided for receiving the edge portion of one of the plates P which are packed within the apparatus 10. It will be appreciated, of course, that the pads 200 are oriented such that the pads 200 associated with the restraining member 74, 76 and 78, 80 at the lower end of the apparatus 10 face upwardly and are thereby adapted to receive the lower edges of the plates P, whereas the pads 200 associated with the yoke members 102, 104 and 106, 108 face downwardly and are thus adapted to receive the upper edges of the plates P within the apparatus 10. Further in accordance with the present invention, it will be noted that when the pads 200 are thus folded in an accordion-like fashion, the tongues or tabs 216 defined by the U-shaped lances 214 in each of the pad sections 202 projects upwardly or downwardly away from the associated recesses R. The dimension of the tabs 216 is such that they are designed to be nestingly received in the channels 82, 84 and 118, 120, with the result that the restraining members 74, 76 and 78, 80 act as a guideway for lateral movement of the pair of pads 200 disposed at the lower end of the apparatus 10. In a similar manner, the restraining members 102, 104 and 106, 108 of the yokes 98, 100, respectively, act as lateral guideways for the pair of pads 200 located adjacent the upper end of the apparatus 10 and are adapted to provide for lateral guiding movement of the upper pads 200 when the upper edges of the plate P are nestingly received within the recesses R defined by the pad sections 202 thereof.

The ends of each of the pads 200 are formed with a generally U-shaped end portion 228 and 230, which portions 228, 230 are adapted to be surmounted over or nestingly receive end plates 232 and 234, respectively, which are preferably fabricated of a suitable shock absorbing material, such as corrugated paper or fiberboard, or the like. The end plates 232, 234 are formed with outwardly projecting shoulder sections 236 and 238, respectively, which are similar in shape to the tabs 216 of the pad sections 202 and are adapted to be slidably received along with the tabs 216 within the associated of the channels 82, 84 and 118, 120. The end plates 232, 234 associated with the lowermost of the pads 200 are respectively disposed directly adjacent the forward side of the front upright members 62 of the vertical frame assemblies 14, 16, and adjacent the inner or rearward side of the lower ends of the stanchions 86, 88. In a similar manner, the end plates 232, 234 associated with the upper pads 200 are disposed adjacent the upper ends of the forward upright members 62 of the frame assemblies 14, 16, and adjacent the inner or rearward sides of the upper ends of the compression stanchions 86, 88.

The apparatus 10 of the present invention is intended to be supplied in a knocked-down or disassembled configuration. Assembly of the apparatus 10 is accomplished by joining the frame assemblies 14, 16 by means of the longitudinally extending cross members 18, 20. By virtue of the fact that the structural components of the apparatus 10, other than the elements 150, 152 (or pads 200), and end shrouds 24, 26, are preferably, although not necessarily, fabricated of a suitable wood, the frame assemblies 14, 16 may be joined to the cross members 18, 20 by means of nails, screws or other suitable fastening means well known in the art. After the components 14–20 have thus been assembled, the frame assemblies 14, 16 are mounted within the channels 82, 84 defined by the restraining members 74, 76 and 78, 80, respectively, of the pallet base 12. The lower ends of the assemblies 14, 16 may be secured within the channels 82, 84 as by nailing or the like. It will be noted that the compression stanchions are not mounted within the channels 82, 84 until after the plurality of frangible plates P to be packed within the apparatus 10 have been placed therewithin. Prior to packing the plates P within the apparatus 10, the forward side thereof is tilted upwardly by providing suitable support means, such as a block of wood or the like, under the forward longitudinal side rail 28, whereby the forward edge of the base 12 is disposed above the rearward edge thereof. The purpose of thus tilting the pallet base 12 rearwardly is to assure that as the successive panels P are packed within the apparatus 10, said panels will lie against the frame assemblies 14, 16 under the influence of gravity and will not tend to fall forwardly due to the absence of any support thereof during the packing operation. Thereafter, the lower separator and retaining elements 152 (or lower pads 200) are placed within the apparatus 10 by inserting the portions 168 thereof within the channels 82, 84, with the recesses 164 facing upwardly. The restraining yokes 98 and 100 are pivoted rearwardly so that they do not interfere in any way with the packing of the plates P into the apparatus 10.

The first plate P may then be placed within the apparatus 10 by inserting the lower edge thereof downwardly within the rearwardly most pair of recesses 164 of the elements 152 (or recesses R of pads 200) supported upon the restraining members 74, 76 and 78, 80. The plate P is centered longitudinally of the apparatus 10 and if desired, suitable end stoppage means may be inserted between the one longitudinal end thereof and one of the lateral end rails 32, 34 of the pallet base 12 to assure against any longitudinal shifting of the plates P. The two upper elements 150 (or pads 200) are next installed above the plate P by placing the upper edge of the plate P within the rearward most recesses 158 of the elements 150. Thereafter, successive plates P may be packaged within the apparatus 10 by inserting the lower edge of each successive plate P within the next forwardly pair of recesses 164 defined by the lower elements 152 and recesses 158 defined by the upper elements 150. The successive plates P should be longitudinally aligned with one another and if desired, suitable plate separator means (not shown) may be interposed between the outer terminal ends thereof so as to assure against any damage which might occur in the event that the plates P are of a relatively arcuate configuration, such as when the plates P consist of vehicular windshields or the like.

Figure 7:
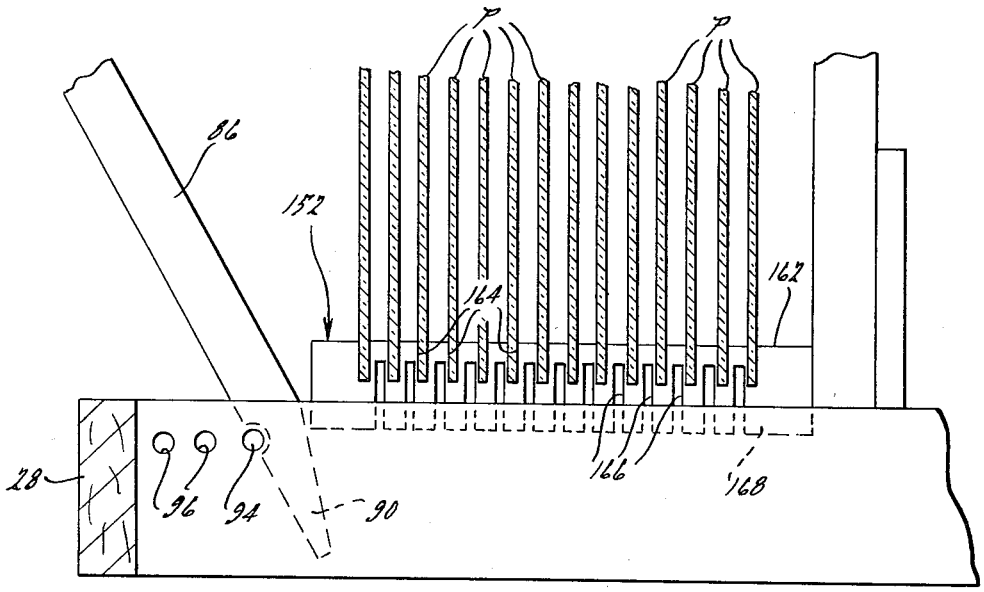
FIG. 7 is an enlarged fragmentary end elevational view of a packing apparatus of the present invention as shown in operative association with a series of frangible plates, with the plates being compressingly restrained within one of the plate separator and retaining elements of the present invention.
Figure 9:
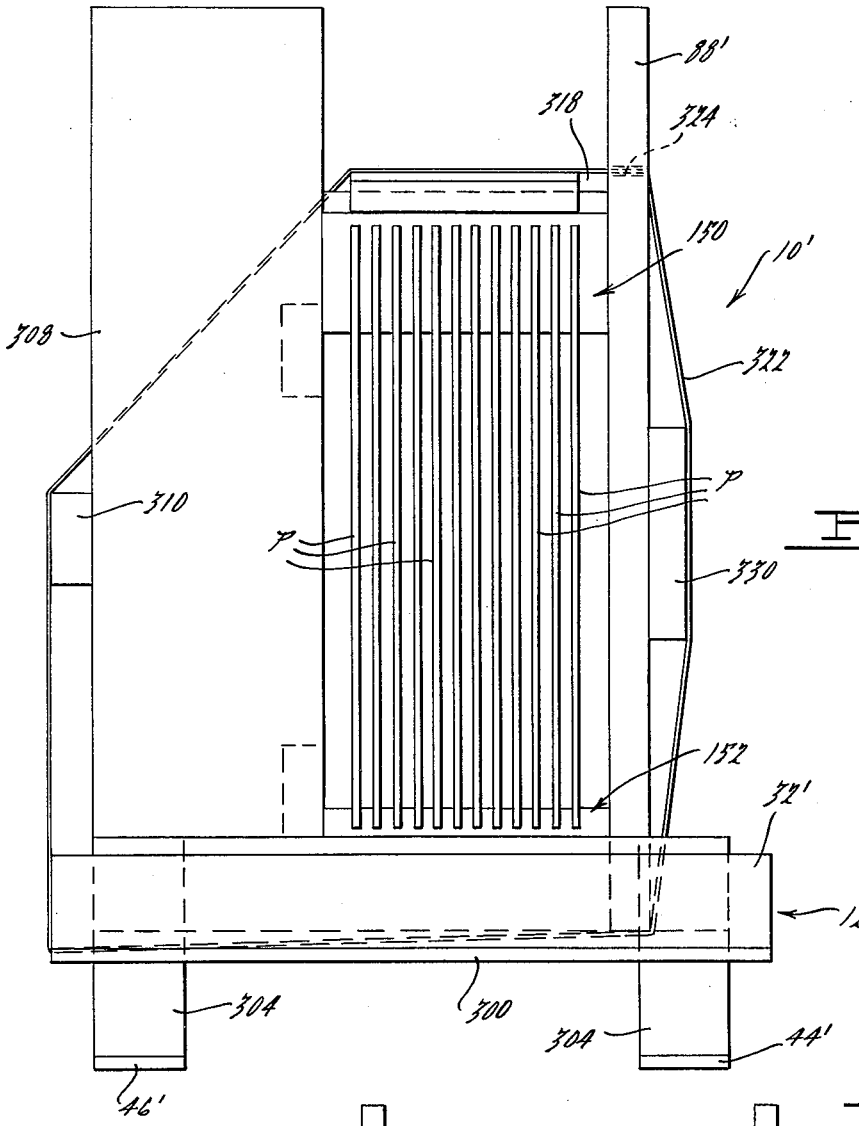
FIG. 9 is an end elevational view similar to FIG. 6 of the apparatus shown in FIG. 8.

After the predetermined number of plates P have been thus placed within the apparatus 10, the lower ends 90, 92 of the stanchions are inserted into the forward ends of the channels 82, 84 on the rearward side of the pivot pins 94, which pins 94 are properly positioned within the apertures 86 in accordance with the number and size of the plates P packaged within the apparatus 10. The compression stanchions 86, 88 are initially inserted into the channels 82, 84 in a manner best seen in FIG. 7 wherein the upper ends of the stanchions 86, 88 are tilted away from the plates P that are being packed. It will be noted that the lower ends 90, 92 of the compression stanchions 86, 88 are preferably formed with suitable notches adapted for engagement with the pivot pins 94, as seen in FIG. 7. After the compression stanchions 86, 88 have thus been inserted into the channels 82, 84, the upper ends of the stanchions 86, 88 are pivoted toward the rearward side of the apparatus 10, i.e., the upper ends of the stanchions 86, 88 are pivoted in a clockwise direction in FIG. 7 from a relatively inclined position to a generally vertical orientation. As the upper ends of the compression stanchions 86, 88 are pivoted rearwardly, the plurality of plates P are caused to move to a general vertical orientation, and at the same time, the upper and lower elements 150 and 152 are compressed, thereby tightly gripping the upper and lower edges of the plates P, whereby to positively restrain the same against any longitudinal or lateral movement within the apparatus 10. Once the stanchions 86, 88 have moved to a general vertical orientation, the restraining yokes 98, 100 are pivoted forwardly or clockwise in FIG. 6 from the general phantom position shown in this FIG. to the solid line position. As the yokes 98, 100 are thus moved toward a general horizontal orientation, the portions 160 of the elements 150 are aligned with the channels 118, 120 defined by the restraining members 102, 104 and 106, 108 constituting the yokes 98, 100. After the yokes 98, 100 have been properly positioned, the wing nuts or the like associated with the bolts 114, 116 may be tightened so as to positively secure the yokes 98, 100 in place. Additionally, if desired, suitable nails or the like may be driven into the compression stanchions 86, 88 and into the forward upright members 62 directly above the yokes 98, 100 to assure positive retention thereof in their respective operative positions shown, for example, in FIGS. 1 and 2.

The next step in assembling the plates P within the apparatus 10 of the present invention is to install the end shrouds 24, 26 into the outer ends of the pallet base 12. As previously mentioned, the shrouds 24, 26 are adapted to be nestingly received interiorly of the side rails 28, 30 and end rails 32, 34 and be supported at the lower ends thereof by means of the reinforcing members 36. Means in the form of suitable staples or the like may be used for securing the shrouds 24, 26 in place. Once the shrouds 24, 26 have thus been installed, the cover 22 may be mounted upon the assemblage consisting of the pallet base 12, frame assemblies 14, 16, plates P and end shrouds 24, 26. As shown in the drawings, the dimensions of the cover 22 are such that the same will embrace the upper ends of the shrouds 24, 26, as well as the upper ends of the frame assemblies 14, 16 and compression stanchions 86, 88. Any suitable means, such as nails, screws, or the like, may be utilized in securing the cover 22 in place, thereby completing the assembly of the apparatus 10 of the present invention.

It will be appreciated that the interior structure of the apparatus 10 is not dependent upon the end shrouds 24, 26; however, the shrouds 24, 26 do serve in a columnar support manner in providing for stacking support in the event a plurality of packing apparatus of the present invention are mounted on top of one another. It will also be appreciated that instead of the shrouds 24, 26 being fabricated of a corrugated paperboard or the like, the same could be fabricated of wooden slats or a wire reinforced structure, as is well known in the art. In addition, it will be appreciated that for certain packing and transport applications, the apparatus 10 may be steel banded to assure the structural integrity thereof.

One particular feature of the present invention resides in the fact that the apparatus 10 occupies a minimum amount of space for containing any given number of frangible plates, as compared to similar structures in the prior art. In addition, the apparatus 10 may be stood on one end or the other thereof, a feature which cannot be accomplished in the prior art and which is provided for in the present invention by virtue of the compression or compaction of the elements 150, 152 (or pads 200) and the interaction thereof with the plates P mounted within the recesses 158, 164. This results in the unified compacted mass of the plates P adding integral strength to the apparatus 10, with the result that the structural integrity thereof is enhanced by the material which is packed therewithin. Another feature of the present invention resides in the fact that the plates P may be packed considerably faster than in prior art designs, thereby providing for a substantial savings in packing time. In addition, the present invention minimizes to the extreme any ancillary dunnage, as compared to prior art designs, which dunnage may be obviated entirely except in the case when certain mixing of plate designs is encountered. In addition, the present invention provides for high visibility of the plates located therewithin, whereby to minimize to the extreme undetected panel damage. Also, universality of interchangeable components allow for incident size options in order to accommodate various panel packing, transport and storage demands. Also, by virtue of the fact that the bottom or underside of the pallet base 12 is of a complementary configuration and is adapted to contiguously engage the upper side of the cover 22 of an apparatus 10 therebelow, substantial vertical stacking and shipping stability is achieved. Yet another feature of the present invention resides in the fact that glass plates may be conveniently dispensed therefrom when the apparatus is either standing upright, as shown in FIGS. 1 and 2, or is lying on its side wherein the plates are horizontally disposed. In the latter situation, successive plates may be conveniently removed from the apparatus by a sled or skid-type device which may be inserted beneath the uppermost plate in the package in a manner such that upon withdrawal of the device, the plate is concomitantly removed from the apparatus. Such horizontal stacking and dispensing is a considerable advance over prior art designs in that in most inventory situations, the need for handling large glass plates on ladders or similar elevating devices is entirely eliminated.

FIGS. 8–12 illustrate a further embodiment of the present invention which will hereafter be described with the components thereof that are analogous to the components of the apparatus 10 being designated by like numerals with a prime suffix. The apparatus 10′ is shown as comprising elongated pallet base 12′ consisting of a pair of longitudinally extending spaced parallel side rails 28' and 30' between which a pair of end rails 32' and 34' extend. A pair of end stringers 300, 302 extend below the side rails 28', 30' adjacent the end rails 32', 34' and function in the same general capacity as the aforedescribed reinforcing members 36 of the apparatus 10. A pair of longitudinally extending stringer members 44', 46' are disposed below the base 12' and connected thereto by suitable vertically extending support legs, generally designated by the numeral 304 located at the opposite members 44', 46'. The members 44', 46' define the lower sides of openings 56', 58' thereto which the tines of a fork-lift truck or the like may be inserted for transporting the apparatus 10' and any plates P contained therein.

Figure 8:
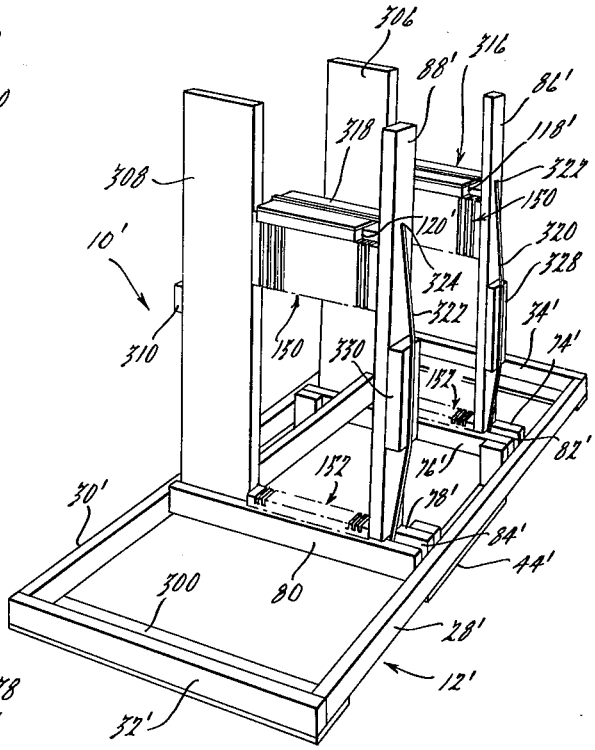
FIG. 8 is an elevated perspective view of an alternate embodiment of the plate packing, transport and storage apparatus of the present invention.

The pallet base 12' includes a pair of spaced apart upright frame members 306 and 308, with a suitable reinforcing cross member 310 extending between the upper ends of the members 306, 308. The lower ends of the members 306, 308 are disposed and secured within spaced apart laterally extending channels 82', 84' which are defined between pairs of restraining members 74', 76' and 78', 80'. As illustrated, the opposite ends of the members 74'–80' are fixedly secured to the side rails 28', 30'. Disposed in confronting relationship to and cooperable with the frame members 306, 308 is a pair of upright stanchion members 86', 88', which include reduced lower end portions 312 and 314, respectively, adapted to be received within the channels 82', 84'. A pair of generally horizontally disposed upper channel members 316 and 318 are disposed between the stanchion members 86', 88' and the adjacent of the upright frame members 306 and 308, with the undersides of the channel members 316, 318 defining horizontally disposed laterally extending channels 118', 120'. The channels 118', 120' are adapted to nestingly receive the upwardly projecting portions 160 of a pair of upper packing elements 150 which may be identical or similar to the aforedescribed elements 150 incorporated in the apparatus 10. In a similar manner, the channels 82', 84' are adapted to nestingly receive the downwardly projecting portions 168 of a pair of lower elements 152 in essentially the same manner as the elements 152 were incorporated in the apparatus 10, with the result that a plurality of frangible plates P may be received with the respective recesses 158 and 164 of the elements 150, 152. In the embodiment of the present invention shown in FIGS. 8–12, instead of having the upper ends of the stanchion members 86', 88' be retained in their respective vertical positions by a pair of yoke members, such retention of the stanchion members 86', 88' is achieved by means of a pair of packaging straps 320, 322. The straps may be fabricated of any suitable material, preferably a suitable metal alloy, as is well known in the freight packaging art. As illustrated in FIG. 8, the straps 320, 322 extend over the upper sides of the channel members 316, 318, downwardly across the rearward side of the apparatus 10' (either on the inboard or outboard sides of the upright frame members 306, 308) thereafter beneath the lower packing elements 152 and plates P supported thereby, and upwardly along the forward sides of the stanchion members 86', 88' and finally through suitable openings 324, 326 formed in the members 86', 88'. Suitable separator blocks 328 and 330 may be provided between the forward sides of the stanchion members 86', 88' and the straps 320, 322 to facilitate tensioning of the straps 320, 322 and installation and removal thereof.

Assembly of the plates P into the apparatus 10' may be accomplished in essentially the same manner as in the case of the apparatus 10, with the exception that after all of the plates P have been installed between the packing elements 150, 152, instead of utilizing the aforedescribed yokes to compressingly secure the plates P within the apparatus 10' the straps 320 and 322 are appropriately tensioned or tightened by suitable strap tightening equipment well known in the art whereupon the stanchion members 86', 88' will be moved laterally within the channels 82, 84 thereby compressing the elements 150, 152 to assure that the edges of the plates within the recesses 158, 164 thereof are tightly secured against relative movement. Thereafter, suitable shroud or cover means may be utilized, such as is indicated by the numeral 340 in FIG. 11 for protecting the plates P within the apparatus 10' during transport, storage, etc.

Figure 13:
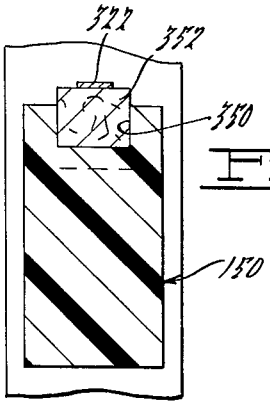
FIG. 13 is a transverse cross-sectional view of an alternate embodiment of the packing elements incorporated in the apparatus of the present invention.
Figure 14:
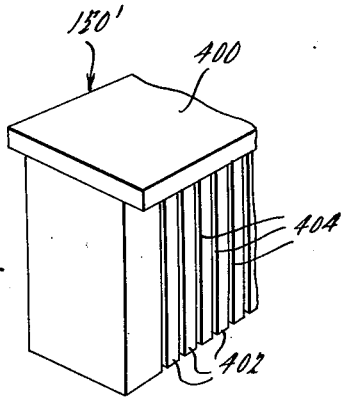
FIG. 14 is an elevated perspective view of still another embodiment of the packing elements incorporated in the apparatus of the present invention.

It will be appreciated that the present invention is not necessarily limited to a construction wherein the packing elements 150, 152 are supported within and guided by channels as hereinabove described. For example, and as illustrated in FIG. 13, the upper sides of the packing elements 150 (as well as the lower sides of the elements 152) may be formed with elongated recesses, as indicated at 350 and be guided for lateral movement relative to and upon a horizontal guide member 352. Thus, the so-called channel can readily be provided in the packing elements per se instead of being formed by a structural part of the apparatus 10 or 10'. It is also to be noted that the packing elements 150, 152 need not necessarily be of a one-piece monolythic structure since it is contemplated that the elements 150, 152 may be of a two-piece construction such as is indicated by the element 150' in FIG. 14. In this Figure the packing element 150' includes an upper body portion 400 fabricated, for example, of suitable urethane material and have a plurality of separate finger portions 402 depend downwardly from and be secured to the underside thereof. The finger portions 402 would define a plurality of plate edge receiving recesses 404 therebetween and could be fabricated of a different material, such as a different type of foam material, i.e. polyethylene, having a different resilient character, i.e. more resilient, less resilient, than the body portion 400, depending upon the particular type and size of plates being packaged therewithin.

It will be noted that the apparatus 10' hereinabove described may be used interchangeably with the aforedescribed apparatus 10 but that significant economies of material, production time, etc., will be experienced through the use of the apparatus 10' instead of the apparatus 10; however, by virtue of the principles of the present invention, no sacrifice in packaging integrity will be experienced even though the apparatus 10' may be constructed at a significant savings in cost over the apparatus 10.

While it will be apparent that the preferred embodiment herein illustrated is well calculated to fulfill the objects stated above, it will be appreciated that the present invention is susceptible to modification, variation and change without departing from the scope of the invention.

We claim:

1. In an apparatus for transporting and storing frangible glass plates or the like, a compressible element defining at least part of a plate edge receiving recess, guideway means arranged at generally right angles to said recess for supporting the element whereby portions thereof defining said recess are movable to and from a position compressingly engaging the opposite sides of a plate edge inserted into said recess, and means for causing said element to move along said guideway means and thereby compressingly engage a plate edge disposed within said recess so as to support, constrain and suspend said plate against movement within the apparatus.

2. The invention as set forth in claim 1 wherein said element is fabricated of a compressible material defining a plurality of plate edge receiving recesses.

3. The invention as set forth in claim 2 wherein said element is fabricated of a deformable foam-like material.

4. The invention as set forth in claim 2 wherein said element is fabricated of a strip of corrugated cardboard-like material.

5. The invention as set forth in claim 1 which includes a relatively rigid frame and wherein said guideway means provides for sliding movement of said element relative to said frame in a direction generally transversely of said recess.

6. The invention as set forth in claim 5 wherein said guideway defines an elongated channel extending generally transversely of a plate disposed within the apparatus, and which includes projection means extending from said element and received in part within said channel for guiding said element therewithin.

7. The invention as set forth in claim 5 wherein said means for causing said elements to compressingly engage a plate edge comprises an upright compression stanchion member which is disposed in a position causing said element to compressingly engage a plate edge disposed within one of said recesses.

8. The invention as set forth in claim 5 which includes means for retaining said stanchion in a generally upright position wherein said element compressingly engages a plurality of plates disposed within the apparatus.

9. The invention as set forth in claim 8 wherein said means for retaining said stanchion comprises a yoke-like member.

10. The invention as set forth in claim 9 wherein said means for retaining said stanchion comprises a tensionable strap.

11. The invention as set forth in claim 1 wherein said guideway means is for supporting a lower compression element and which includes a second guideway means for retaining an upper compression element.

12. The invention as set forth in claim 11 wherein said second guideway means and upper compression element are arranged in generally overlying relation to said first mentioned element and adapted to compressingly engage the upper edge of a plate disposed within the apparatus.

13. The invention as set forth in claim 8 which includes means defining two pair of longitudinally spaced vertically aligned channels extending generally transversely of a plate disposed within the apparatus, which includes four elements associated one with each of said channels and movable to a position compressingly engaged with a plate disposed within the apparatus, which includes a pair of stanchion members, and means causing said stanchion members to compress said elements.

14. The invention as set forth in claim 13 which includes enclosure means disposed in generally surrounding relationship to plates within the apparatus for protecting the same.

15. The invention as set forth in claim 14 wherein said enclosure means includes a pair of end shrouds extending around the outer ends of plates disposed within the apparatus.

16. In an apparatus for packing, transporting and storing frangible plates and the like, first and second spaced apart compressible elements defining pairs of aligned plate edge receiving recesses, said pairs of aligned recesses adapted to receive opposed edges of plate-like materials within the apparatus, first and second guideway means slidably supporting said elements whereby at least the portions thereof defining said recesses are slidably movable to and from a position compressingly engaging the sides of the plate-like materials adjacent said edges, and means for sliding said portions of said elements within said guideways and thereby applying a compressive force against said elements and simultaneously biasing said portions toward said position wherein said portions compressingly engage said sides of said materials and so as to restrain said materials against movement relative to said apparatus.

17. The invention as set forth in claim 16 wherein said elements are fabricated of a compressible and deformable molded polymeric material.

18. The invention as set forth in claim 17 which includes means on said elements cooperative with said guideways.

19. The invention as set forth in claim 18 wherein said guideways define elongated channels extending generally transversely of a plate disposed within the apparatus, and which includes projection means extending from said elements and received in part within said channels for guiding said elements therewithin.

20. The invention as set forth in claim 19 wherein said means for applying a compressive force against said elements comprises an elongated stanchion member adapted to compressingly engage said elements.

21. The invention as set forth in claim 20 wherein said means for applying a compressive force against said elements includes a strap-like member operable to retain said stanchion member in a generally upright position and assure compressing engagement of said elements with a plate disposed within said recesses of said elements.

22. The invention as set forth in claim 20 which includes yoke means for retaining said stanchion in a generally upright position wherein at least one of said elements compressingly engages a plurality of plates disposed within the apparatus.

23. The invention as set forth in claim 22 wherein said yoke means defines one of said channels at a position in generally overlying relation to the other of said channels.

24. The invention as set forth in claim 16 which includes means defining two pair of vertically spaced, longitudinally aligned channels extending generally transversely of a plate disposed within the apparatus, which includes four elements associated one with each of said channels adapted to compressingly engage a plate disposed within the apparatus, and which includes a pair of stanchion members for causing said elements to compressingly engage the opposite edges of said plate disposed within the apparatus.

25. The invention as set forth in claim 16 which includes an elongated pallet base for said apparatus.

26. The invention as set forth in claim 25 which includes shroud means supported upon said pallet base and extending around the terminal ends of plates disposed within said apparatus for protecting the same.

27. In an apparatus for packing, transporting and storing vehicular windshields and similar frangible plate-like articles, first and second compressible elements spaced longitudinally along the articles, each of said elements defining a series of recesses, with the recesses of said first element being generally longitudinally aligned with the recesses of said second element, whereby articles packed within the apparatus may have one longitudinal edge thereof nested within a pair of aligned recesses in said elements, guideway means supporting said elements whereby at least the portions thereof defining said recesses are slidably movable to and from a position compressingly engaging the sides of the plate-like articles adjacent said edges, and means for applying a compressive force against said elements whereby said portions compressingly engage said sides of said articles and thereby restrain said articles against movement relative to said apparatus.

28. The invention as set forth in claim 27 wherein said elements are fabricated of a deformable foam-like material.

29. The invention as set forth in claim 27 wherein said guideway means comprises a pair of longitudinally spaced guideways extending generally transversely of the plate and adapted to support said elements for sliding movement in a direction generally transversely of said elements.

30. The invention as set forth in claim 29 which includes means on said elements cooperative with said guideways to provide for movement of said elements along said guideways.

31. The invention as set forth in claim 30 wherein said guideways define elongated channels extending generally transversely of a plate disposed within the apparatus, and which includes projection means depending from said elements and received in part within said channels for guiding said elements therewithin.

32. The invention as set forth in claim 31 wherein said means for applying a compressive force comprises a pair of upright members which are movable to a position causing said elements to compressingly engage a plate edge disposed within said recesses.

33. The invention as set forth in claim 32 which includes yoke means for retaining said stanchions in a generally upright position wherein said elements compressingly engage a plurality of plates disposed within the apparatus.

34. The invention as set forth in claim 33 which includes a strap-like member for retaining said stanchions in a generally upright position.

35. The invention as set forth in claim 31 which includes third and forth elements arranged in generally overlying relation to said first and second elements and adapted to compressingly engage the opposite edge of a plate disposed within the apparatus.

36. The invention as set forth in claim 27 which includes a pair of generally vertical frame members supported on a pallet base, which includes two pair of restraining members extending transversely of the pallet base and each pair defining an elongated channel, the lower ends of said frame assemblies being disposed within said channels, which includes two stanchion members having their lower ends disposed one within each of said channels, which includes a pair of retaining members for retaining said stanchion members in an upright position.

37. The invention as set forth in claim 36 wherein said retaining members comprise a pair of tensionable strap-like members adapted to extend around a portion of said frame for retaining said stanchion members in a generally upright position.

38. The invention as set forth in claim 36 which includes a plurality of four recessed elements, each of said elements having means cooperable with one of said channels, with said means being slidably disposed within the associated of said channels to provide for guided movement therewithin.

39. The invention as set forth in claim 38 wherein at least two of said elements are formed with a plurality of elongated flexible fingers defining recessed areas therebetween.

40. The invention as set forth in claim 39 wherein at least one of said elements is fabricated of two different foam-like materials.

41. The invention as set forth in claim 39 wherein at least one of said elements is fabricated of an accordion-shaped foam material.

* * * * *

UNITED STATES PATENT AND TRADEMARK OFFICE

CERTIFICATE OF CORRECTION

PATENT NO. : 3,985,231

DATED : October 12, 1976

INVENTOR(S) : David L. Farhat and Richard S. Reihm

It is certified that error appears in the above-identified patent and that said Letters Patent are hereby corrected as shown below:

Col. 2, line 20, "afore-mentioned" should be --aforementioned--;
Col. 5, line 45, "is two pair" should be --are two pairs--;
Col. 8, line 16, delete "a" first occurrence;
Col. 8, line 35, "accordian" should be --accordion--;
Col. 13, line 39, "150" should be --150'--;
Col. 13, line 43, "152" should be --152'--;
Col. 13, line 48, "150, 152" should be --150', 152'--;
Col. 14, line 7, "150, 152" should be --150', 152'--;
Col. 14, line 14, "150, 152" should be --150', 152'--;
Col. 14, line 23, "150, 152" should be --150', 152'--;
Col. 14, line 26, "150" should be --150'--;
Col. 14, line 27, "152" should be --152'--;
Col. 14, line 33, "150, 152" should be --150', 152'--;
Col. 14, line 34, "monolythic" should be --monolithic--;
Col. 14, line 35, "150, 152" should be --150', 152'--;
Col. 15, line 49, "9" should be --8--;
Col. 15, line 63, "pair" should be --pairs--;
Col. 16, line 64, "pair" should be --pairs--;
Col. 18, line 22, "pair" should be --pairs--;

Signed and Sealed this

Seventh Day of June 1977

[SEAL]

*Attest:*

RUTH C. MASON
*Attesting Officer*

C. MARSHALL DANN
*Commissioner of Patents and Trademarks*